US006578489B2

(12) United States Patent
Boyer et al.

(10) Patent No.: US 6,578,489 B2
(45) Date of Patent: Jun. 17, 2003

(54) PYROTECHNIC INITIATION DELAY MEANS

(75) Inventors: Jean-Louis Boyer, Collobrieres (FR); Andre Gilson, Brussells (BE); Raymond Rion, Champion (BE)

(73) Assignees: Bureau de la Propriete Intellectuelle de la Delegation Generale pour l'Armement, Arcueil Cedex (FR); Jason Engineering S. A., Brussells (BE)

( * ) Notice: Subject to any disclaimer, the term of this patent is extended or adjusted under 35 U.S.C. 154(b) by 0 days.

(21) Appl. No.: 09/986,780

(22) Filed: Nov. 9, 2001

(65) Prior Publication Data

US 2002/0046673 A1 Apr. 25, 2002

(30) Foreign Application Priority Data

Nov. 9, 2000 (FR) ..... 00 14390

(51) Int. Cl.[7] ..... F42C 1/00; F42C 9/06; C06D 5/00

(52) U.S. Cl. ..... 102/272; 102/277; 102/277.1; 102/276; 102/200

(58) Field of Search ..... 102/200, 204, 102/272, 268, 265, 487, 276, 277–277.2

(56) References Cited

U.S. PATENT DOCUMENTS

| | | | | | |
|---|---|---|---|---|---|
| 3,638,572 | A | * | 2/1972 | Menichelli | 102/277.1 |
| 3,786,754 | A | * | 1/1974 | Donahue et al. | 102/238 |
| 3,823,669 | A | | 7/1974 | Zacharin | |
| 4,019,132 | A | | 4/1977 | Ernst | |
| 4,078,496 | A | * | 3/1978 | Kruger et al. | |
| 4,119,040 | A | * | 10/1978 | Lerman | 102/277.2 |
| 4,480,551 | A | * | 11/1984 | LoFiego | 102/272 |
| 4,730,559 | A | * | 3/1988 | Brightman | 102/487 |
| 4,860,657 | A | * | 8/1989 | Steinicke et al. | |
| 5,046,567 | A | * | 9/1991 | Aitken et al. | |
| 5,635,667 | A | | 6/1997 | Boyer et al. | |
| 5,686,692 | A | * | 11/1997 | Watson, Jr. | |

FOREIGN PATENT DOCUMENTS

| | | | | |
|---|---|---|---|---|
| DE | 1 147 516 B | | 4/1963 | |
| DE | 1 428 801 | | 4/1969 | |
| FR | 2 353 041 A | | 12/1977 | |
| FR | 2 458 790 A | | 1/1981 | |
| FR | 2 465 189 A | | 3/1981 | |
| FR | 2 557 969 A | | 7/1985 | |
| FR | 2 721 394 A | | 12/1995 | |
| GB | 2095374 | * | 9/1982 | 102/272 |
| WO | WO 94/25819 | | 11/1994 | |

* cited by examiner

*Primary Examiner*—Charles T. Jordan
*Assistant Examiner*—Lulit Semunegus
(74) *Attorney, Agent, or Firm*—Oliff & Berridge, PLC

(57) ABSTRACT

A pyrotechnic initiation delay device intended in particular to cooperate with a device for firing a pyrotechnic charge of the fuze type, particularly for a hand grenade, having a delay composition located inside a delay column, the latter having a lower end and an upper end, a percussion primer being able to cooperate with the upper part of the delay column, and a striker piston held firmly under the lower end of the delay column and able to move axially in the direction of the element to be struck under the action of an explosive charge cooperating with the lower end of the delay column. The delay column communicates with the explosive charge through a cavity containing plugging means allowing or preventing movement of the striker piston under the effect of the explosive charge.

18 Claims, 3 Drawing Sheets

PYROTECHNIC INITIATION DELAY MEANS

BACKGROUND OF THE INVENTION

The technical area of the invention is that of devices for firing a pyrotechnic charge, particularly for a hand grenade, and specifically that of pyrotechnic initiation delay means in a pyrotechnic chain.

Pyrotechnic delay elements have been used for a number of years in various areas, such as the firing of detonators in mines and quarries, and rockets of all types (artillery, infantry, mine, grenade, mortar, etc.). They are as numerous as they are indispensable and may be defined as elements in a pyrotechnic chain wherein they provide a time interval between a priming action and a specific response.

The importance of the time interval no longer needs to be demonstrated. In both civil detonation applications and in hand or rifle grenades, poor functioning of the delay element can have catastrophic consequences. Hence it is important to use delay devices that are under full control, but it is also important to counter all the unwelcome consequences of a design or assembly error.

In this technical area, several designs have been proposed. The various pyrotechnic initiation delay means are still somewhat similar in general concept however. They consist of a percussion primer designed to be struck by a striker to ignite a delay composition whose purpose is to be consumed and, in turn, ignite another element in the pyrotechnic chain.

This is what, in particular, is taught by DE 1,428,801 in which the pyrotechnic initiation delay means comprises a percussion primer which is in direct contact with the delay composition which, once combustion is complete, ignites an explosive charge. This technique is also found in U.S. Pat. No. 3,823,669 and FR 2,353,041.

A similar technique consists of replacing the explosive or booster charge by a detonator which ensures that ignition of the pyrotechnic chain continues. This is, in particular, the technique used in FR 2,465,189 and FR 2,458,790.

In the aforesaid documents, ignition of the explosive charge or activation of the detonator by the delay composition directly brings about fire propagation in the pyrotechnic chain and explosion of the hand grenade type pyrotechnic charge by means of the fuze in which the firing device is located.

For safety reasons, FR 2,721,394 proposes placing a striker between the booster charge ignited by the delay composition and the rest of the pyrotechnic chain comprising, in particular, a detonator and another explosive charge. The striker is provided with an explosive charge enabling it, with the aid of the gases released by the reaction of the explosive charge, to pivot about its axis and thus strike another percussion primer to continue ignition of the pyrotechnic chain.

These documents as a group, however, have a non-negligible drawback in that, when the delay composition is consumed, the fire propagates instantly to the rest of the pyrotechnic chain. When they are ignited, these compositions normally burn regularly and, depending on their nature, determine a combustion time proportional to the height of the delay column in which the delay composition is located or the quantity of powder itself. Generally, the composition is loaded by metering and successive compressions in increments with high compressive forces to ensure high and consistent density of the delay composition. Obviously, too little compression will give the delay column insufficient compactness to withstand outside constraints, such as impacts, vibrations, and transportation, but in particular will lead to erratic delay times that could cause severe injury to the user or cause destruction not controlled by the firing devices. It should also be noted that these drawbacks persist if the delay composition is not loaded into the delay column.

It is nonetheless possible to guard against these anomalies by various techniques, such as measuring, x-ray inspection, or neutrinography; but, even at the proper height it is extremely difficult to evaluate the density of the column with these types of techniques, which are also very burdensome.

SUMMARY OF THE INVENTION

The goal of the invention is thus to overcome the above-listed drawbacks by proposing pyrotechnic initiation delay means to improve handling safety prior to the ignition of fuzes, particularly for a hand grenade.

Another goal of the invention is to provide pyrotechnic initiation delay means for pyrotechnic charge firing devices that reduces explosion hazards when transported or carried by potential combat troops.

Another goal is the possibility of storing grenades equipped with their fuzes, contrary to classical fuzes which must be stored away from the grenades.

A final goal of the invention is to reduce the cost of pyrotechnic charge firing devices by using pyrotechnic initiation delay means enabling the costs directly linked to compactness analysis of the delay charge to be reduced.

For this purpose, the invention relates to pyrotechnic initiation delay means intended, in particular, to cooperate with a device for firing a pyrotechnic charge of the fuze type, particularly for a hand grenade, comprising a delay composition located inside a delay column, the latter having a lower end and an upper end, a percussion primer being able to cooperate with the upper part of the delay column, and a striker piston held firmly under the lower end of the delay column and able to move axially in the direction of the element to be struck under the action of an explosive charge cooperating with the lower end of the delay column. The delay column communicates with the explosive charge through a cavity containing plugging means allowing or preventing movement of the striker piston under the effect of the explosive charge.

According to one preferred embodiment of the invention, the plugging means is made of rigid slag resulting from the combustion reaction of the delay composition. The striker piston preferably has an internal cavity which the explosive charge is likely to enter to substantially deform the walls of this internal cavity when the explosive charge explodes. The percussion primer is preferably of the boxer type and is fitted into a primer holder which, itself, is fitted into a delay holder that includes the delay column previously loaded with the delay composition.

The expansion chamber can be located inside the delay holder and between the delay composition and the percussion primer.

According to a preferred embodiment of the invention, the delay holder is screwed onto a body provided with a through-bore able to guide the striker piston which is held under the lower end of the delay column by a collar. The explosive charge enabling the striker piston to be moved may be located in a cavity inside the piston and be composed of lead azide, lead dinitroresorcinate, or lead styphnate. Finally, these means may be associated with a detonator strikable by the striker piston, the detonator being confined in a rotor or a bolt which can be pivoted by an outside force.

These pyrotechnic initiation delay means have the advantage of being fully under control and are, hence, able to counter all the unwelcome consequences of a design or assembly error.

Another advantage resides in the prevention of premature or instantaneous firing of a pyrotechnic charge located under the delay column, whether during handling before the launch, during storage, or during transportation. Such firing may result from an incomplete or incorrectly loaded delay column, of an insufficiently compressed type, or with a total absence of the delay composition.

Other features and advantages of the invention will emerge from the nonlimiting detailed description below.

BRIEF DESCRIPTION OF THE DRAWINGS

The description refers to the attached drawings, of which.

DETAILED DESCRIPTION OF PREFERRED EMBODIMENTS

Figure 1:
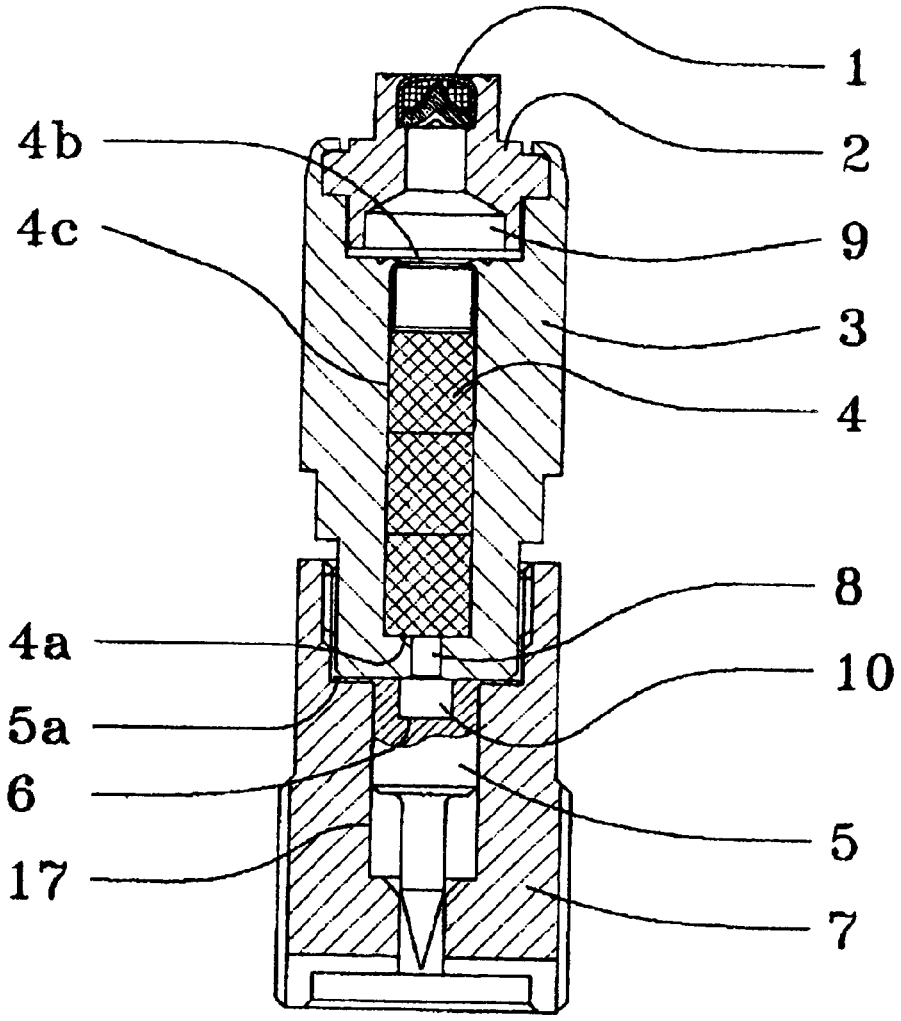
FIG. 1 is a lengthwise sectional view of the pyrotechnic initiation delay means before combustion of the delay composition.
Figure 2:
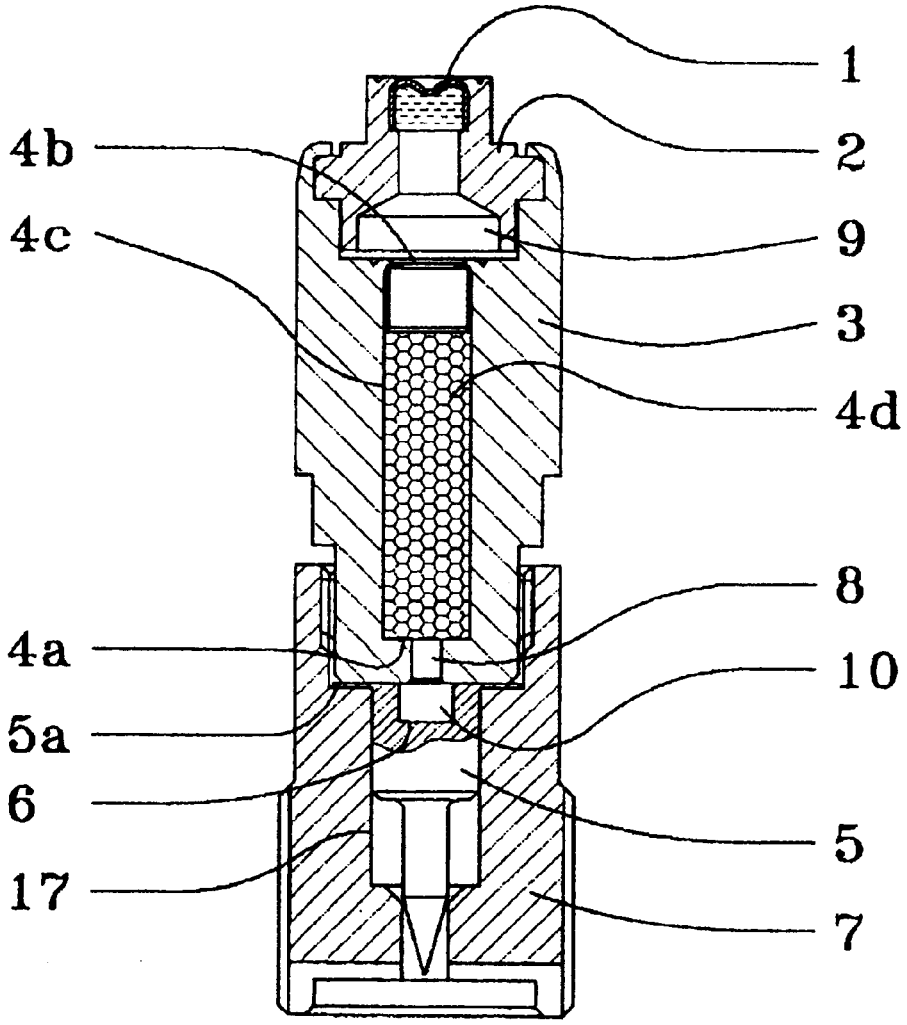
FIG. 2 is a lengthwise sectional view of the pyrotechnic initiation delay means after combustion of the delay composition and before explosion of the explosive charge.

FIGS. 1 and 2 show pyrotechnic initiation delay means designed, in particular, to cooperate with a device for firing a pyrotechnic charge (not shown). These means may be part of a pyrotechnic charge firing device of the fuze type, for hand grenades in particular (as described in FR 2,721,394), rocket grenades, mines, artillery or mortar rockets, or any other pyrotechnic application requiring such a delay.

These means include a percussion primer 1 of the boxer type, inserted and fitted into a primer holder 2. The device can of course operate with an electrical primer instead of a percussion primer. The assembly, comprised of the primer 1 and the primer holder 2, is itself positioned and fitted into a delay holder 3, the joins being sealed by a bead of varnish, epoxy, or cyanoacrylate. The delay holder 3 is first loaded with a delay composition 4 inside a delay column 4*c* having two ends 4*a*, 4*b*. The delay composition 4 is of the "millisecond" or "second" type depending on the use to be made of the pyrotechnic train. For example, for a hand grenade, the nominal combustion time will be between 3.5 and 5 seconds, while for a mortar rocket with launch safety, the time will be between 100 and 500 milliseconds. These combustion times are governed by numerous parameters that must be integrated when the delay composition 4 is prepared; these parameters are very well known to the individual skilled in the art. They are, in particular, the nature of the ingredients, the nature of the binder, the grain size and purity of the components, the hygroscopicity, the degree of compression of the delay composition in the delay column, the gas pressure generated, the nature of the holder, and the diameter of the delay column.

The delay column 4*c* is loaded by incremental metering. It is also possible to add an ignition charge at the top of the delay column 4*c*. The ignition composition is then compressed at the same pressure as the delay powder.

The delay holder 3 has an expansion chamber 9 located between the percussion primer 1 and the upper end 4*b* of the delay column 4*c*. The delay holder 3, in the preferred embodiment of the invention, is screwed onto a body 7 provided with a through-bore 17 enabling a striker piston 5 to be moved and guided. The latter is attached firmly between the body 7 and the delay holder 3, under the lower end 4*a* of the delay column.

The striker piston is held firmly in position by a collar 5*a* but could also be held by means, such as a spring, a thin, breakable seal, or an O-ring or washer. The metallic nature of striker piston 5 and the thickness of collar 5*a* then define an explosive charge 10 to be added to ensure proper operation of these means. In this embodiment, explosive charge 10 is contained in an internal cavity 6 in the striker piston but could also be outside the striker piston 5 as, in particular, in the delay holder 3. The advantage of this arrangement with the explosive charge 10 inside the striker piston 5 is to provide additional safety of the pyrotechnic initiation means which will be described in the functioning of these means. This explosive charge 10 communicates with the lower end 4*a* of the delay column 4*c* through a cavity 8 containing plugging means 4*d* in which the gases generated by the explosion of explosive charge 10 are confined. According to one preferred embodiment of the invention, the plugging means 4*d* of cavity 8 are comprised of solid slag resulting from the combustion reaction of delay composition 4 in delay column 4*c*.

Figure 3:
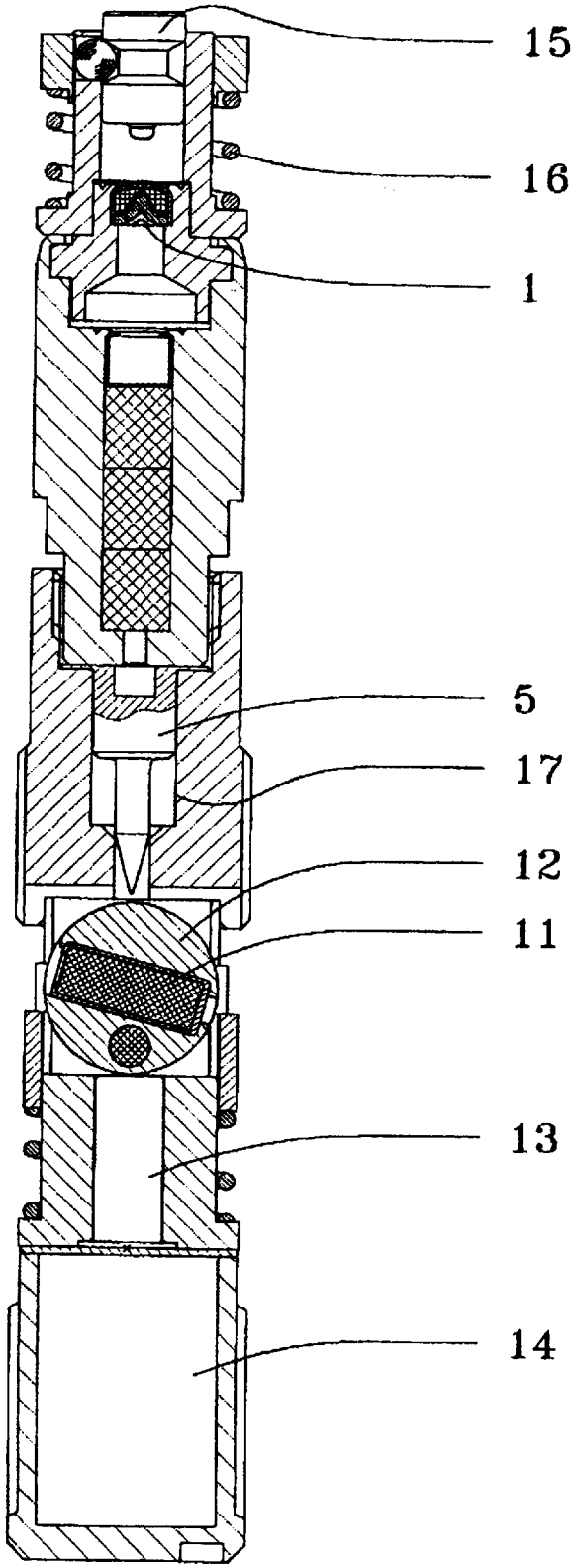
FIG. 3 is a lengthwise sectional view of the pyrotechnic initiation delay means before combustion of the delay composition and associated with another element in the pyrotechnic chain including a detonator and a booster.

FIG. 3 shows pyrotechnic initiation delay means associated with another element in the pyrotechnic chain comprising a detonator 11, a relay 13, and a booster 14 ensuring firing of the rest of the pyrotechnic chain. The detonator 11 is located inside a rotor or bolt 12 which can align with the striker piston and the relay 13 when urged from outside. It should be noted that percussion primer 1 can be associated with a striker 15 and a spring 16 that act by compression.

The operation of these pyrotechnic initiation delay means is as follows. When delay column 4*c* is correctly charged for its entire height and to the right density, it has a substantial mass of rigid, solid slag formed by combustion of the delay composition 4 and occupying substantially the same volume as that of the delay composition 4 prior to combustion. The fire propagates in the first phase throughout the delay composition 4 activated by the previously struck percussion primer 1. When the flame reaches the bottom of the delay column 4*c*, it fires the explosive charge 10 contained in striker piston 5. This explosion generates a large amount of gas which remains confined in cavity 8 because the delay column has been plugged by the solid slag 4*d*. The purpose of this reaction is to shear off the collar and force the striker piston downward. The latter can then strike detonator 11.

However, to reinforce the safety of these means when the striker piston 5 is released accidentally despite a correctly loaded delay composition, the means according to a preferred embodiment of the invention are disposed such that the explosive charge 10 is located in a cavity 6 inside striker piston 5. These accidental starts may occur for many reasons influencing the delay composition 4 or the explosive charge 10, both being deemed to be highly sensitive. They include extreme environmental conditions, such as high temperatures or accidental conditions occurring during storage, transportation, or handling, before such means are implemented. It should be noted that other factors may intervene in the accidental release of the piston, such as being struck by a bullet, or the primary explosive detonating because of an outside explosion. Despite the fact that the detonator 11 is misaligned from the striker piston 5, there is always a risk of propagation of hot gases or flames generated by the explosion of the explosive charge 10 that could bring about combustion of the relay 13 and all the unwelcome consequences that the detonation may produce. For this reason, the explosive charge 10 is placed inside the striker piston 5 in this preferred embodiment. When the piston is released, the deformable walls of the cavity 6 inside piston 5 will deform following explosion of the explosive charge 10, and press against the bore 17 in which piston 5 can move. The pressing of the deformable walls will prevent hot gases and flames from propagating between the bore 17 and striker piston 5 and in sets of moving parts of the pyrotechnic initiation means. The flames and gas generated will thus remain confined in the upper part of the pyrotechnic initiation means due to the seal created by the deformation of the walls of internal cavity 6 which may then prevent the ignition of misaligned detonator 11 or, more seriously, of relay 13.

Still with regard to the operation of the pyrotechnic initiation means, if for some reason, such as the absence of delay composition 4 or incomplete, incorrect, or non-compact loading of delay column 4*c*, the percussion primer 1 or delay composition 4 ignites the explosive charge 10 contained in the striker piston 5, the gases will expand in a volume greater than that of cavity 8. Indeed, the quantity of rigid slag formed by combustion of the delay composition will not be large enough to withstand the pressure of the gases generated by this combustion. These gases will then pass through the slag plug and become distributed in a volume equal to that of the delay composition 4, plus that of expansion chamber 9. Because of this, the reaction will be insufficient to shear off the collar and force the striker piston downward; hence there will be no final effect on the pyrotechnic train, even if the detonator 11 should become misaligned.

Hence we can see the safety of the invention in this principle. Checks for the presence of delay compositions may be reduced, and the simplicity of the device enables it to be adapted to all devices that include a pyrotechnic delay.

Of course, a number of changes may be made by the individual skilled in the art to the pyrotechnic delay means described above solely as a nonlimiting example, without departing from the scope of protection defined by the attached claims.

What is claimed is:

1. A pyrotechnic initiation delay means intended in particular to cooperate with a device for firing a fuze type pyrotechnic charge, comprising:

a delay column;

a delay composition located inside the delay column, the delay column having a lower end and an upper end;

a percussion primer cooperating with the upper part of the delay column;

a striker piston held firmly under the lower end of the delay column and able to move axially; and an explosive charge cooperating with the lower end of the delay column, wherein the lower end of the delay column communicates with the explosive charge through a cavity containing plugging means controlling movement of the striker piston under the effect of the explosive charge, the plugging means made of rigid slag resulting from the combustion reaction of the delay composition.

2. The pyrotechnic initiation delay means according to claim 1, wherein the striker piston has an internal cavity into which gases generated by the explosive charge are likely to enter to substantially deform the walls of the internal cavity when the explosive charge explodes.

3. The pyrotechnic initiation delay means according to claim 1, further comprising:

a primer holder; and a delay holder, wherein the percussion primer is of the boxer type and is fitted into the primer holder, the percussion primer and the primer holder being fitted into the delay holder.

4. The pyrotechnic initiation delay means according to claim 2, further comprising:

a primer holder; and a delay holder, wherein the percussion primer is of the boxer type and is fitted into the primer holder, the percussion primer and the primer holder being fitted into the delay holder.

5. The pyrotechnic initiation delay means according to claim 2, further comprising:

a primer holder; and a delay holder, wherein the percussion primer is of the boxer type and is fitted into the primer holder, the percussion primer and the primer holder being fitted into the delay holder.

6. The pyrotechnic initiation delay means according to claim 3, wherein the delay holder comprises the delay column previously loaded with the delay composition.

7. The pyrotechnic initiation delay means according to claim 3, wherein the delay holder includes an expansion chamber, the latter being located between the percussion primer and the delay composition.

8. The pyrotechnic initiation delay means according to claim 6, wherein the delay holder includes an expansion chamber, the latter being located between the percussion primer and the delay composition.

9. The pyrotechnic initiation delay means according to claim 3, further comprising a body provided with a through-bore, wherein the delay holder is screwed onto the body provided with the through-bore able to guide the striker piston.

10. The pyrotechnic initiation delay means according to claim 6, further comprising a body provided with a through-bore, wherein the delay holder is screwed onto the body provided with the through-bore able to guide the striker piston.

11. The pyrotechnic initiation delay means according to claim 7, further comprising a body provided with a through-bore, wherein the delay holder is screwed onto the body provided with the through-bore able to guide the striker piston.

12. The pyrotechnic initiation delay means according to claim 9, wherein the striker piston is placed firmly between the delay holder and the body by collar-type means.

13. The pyrotechnic initiation delay means according to claim 1, wherein the explosive charge is a lead azide, lead dinitroresorcinate, or lead styphnate type explosive charge.

14. The pyrotechnic initiation delay means according to claim 7, wherein the explosive charge is a lead azide, lead dinitroresorcinate, or lead styphnate type explosive charge.

15. The pyrotechnic initiation delay means according to claim 1, wherein the striker piston is driven onto a detonator confined in a rotor or a bolt which can be pivoted by an outside force to become aligned with the striker piston and a relay leading to a booster charge.

16. The pyrotechnic initiation delay means according to claim 12, wherein the striker piston is driven onto a detonator confined in a rotor or a bolt which can be pivoted by an outside force to become aligned with the striker piston and a relay leading to a booster charge.

17. The pyrotechnic initiation delay means according to claim 1, wherein the percussion primer cooperates with a striker.

18. The pyrotechnic initiation delay means claim 7, wherein the percussion primer cooperates with a striker.

* * * * *